United States Patent [19]

Brown et al.

[11] 4,165,669

[45] Aug. 28, 1979

[54] MODULAR TURRET PUNCH PRESS

[75] Inventors: Paul R. Brown, Akron; Robert P. DeGeorge, Kenmore; Adrien P. Malof, N. Tonawanda; Michael F. Dutton, Newfane; Percy L. Cady, Darien Center; Eugene G. Lawrie, Lockport, all of N.Y.

[73] Assignee: Strippit Division, Houdaille Industries, Inc., Akron, N.Y.

[21] Appl. No.: 879,213

[22] Filed: Feb. 21, 1978

Related U.S. Application Data

[63] Continuation of Ser. No. 698,473, Jun. 21, 1976, abandoned.

[51] Int. Cl.[2] ..... B21D 37/04

[52] U.S. Cl. ..... 83/552; 83/698

[58] Field of Search ..... 83/552, 698; 408/35; 29/568; 72/442

[56] References Cited

U.S. PATENT DOCUMENTS

| | | | |
|---|---|---|---|
| 842,729 | 1/1907 | Vernat | 83/552 X |
| 1,988,935 | 1/1935 | Bollaert | 83/552 |
| 3,165,962 | 1/1965 | Bredow | 83/552 X |
| 3,174,378 | 3/1965 | Friedland et al. | 83/552 X |
| 3,527,130 | 9/1970 | Knehans | 83/552 X |
| 3,902,389 | 9/1975 | Brown | 83/552 X |
| 3,938,416 | 2/1976 | Beauplat | 83/552 |
| 3,951,026 | 4/1976 | Beauplat | 83/552 |

*Primary Examiner*—J. M. Meister

*Attorney, Agent, or Firm*—Hill, Van Santen, Steadman, Chiara & Simpson

[57] ABSTRACT

A turret punch machine is disclosed having upper and lower turrets each equipped to carry a plurality of tools. The turrets carry a plurality of modules projecting from a central turret section in spoke-like fashion. The modules on the upper turret are each adapted to carry one or more punching tool assemblies and the modules on the lower turret are each adapted to carry one or more die tools. The modules are attached to and rotate with the turret by interfitting connections adjacent the modules' inner peripheries, the modules being easily detachable from the turrets to allow quick tool and/or module change.

18 Claims, 9 Drawing Figures

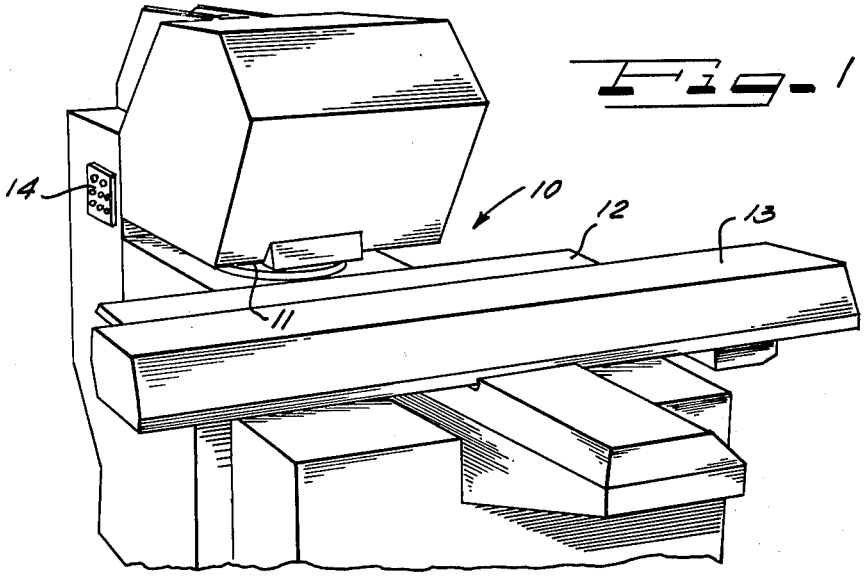
Fig-1
14
10
12
13
11
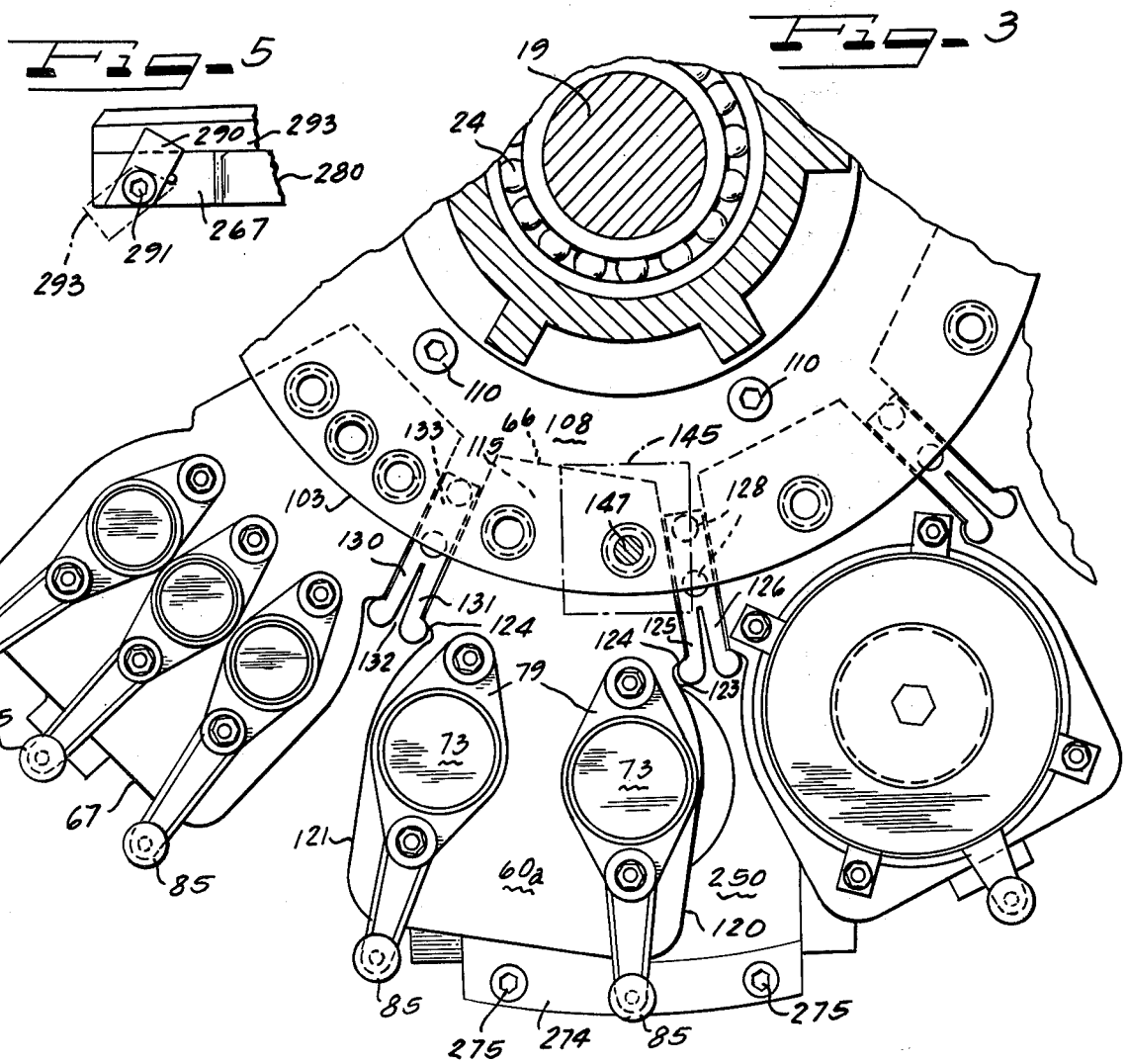
Fig-5
290
293
280
267
291
293
Fig-3
19
24
110
110
133
66
108
145
115
147
128
103
130
131
124
124
125
126
132
79
123
85
73
73
67
121
60a
250
120
85
85
275
274
85
275

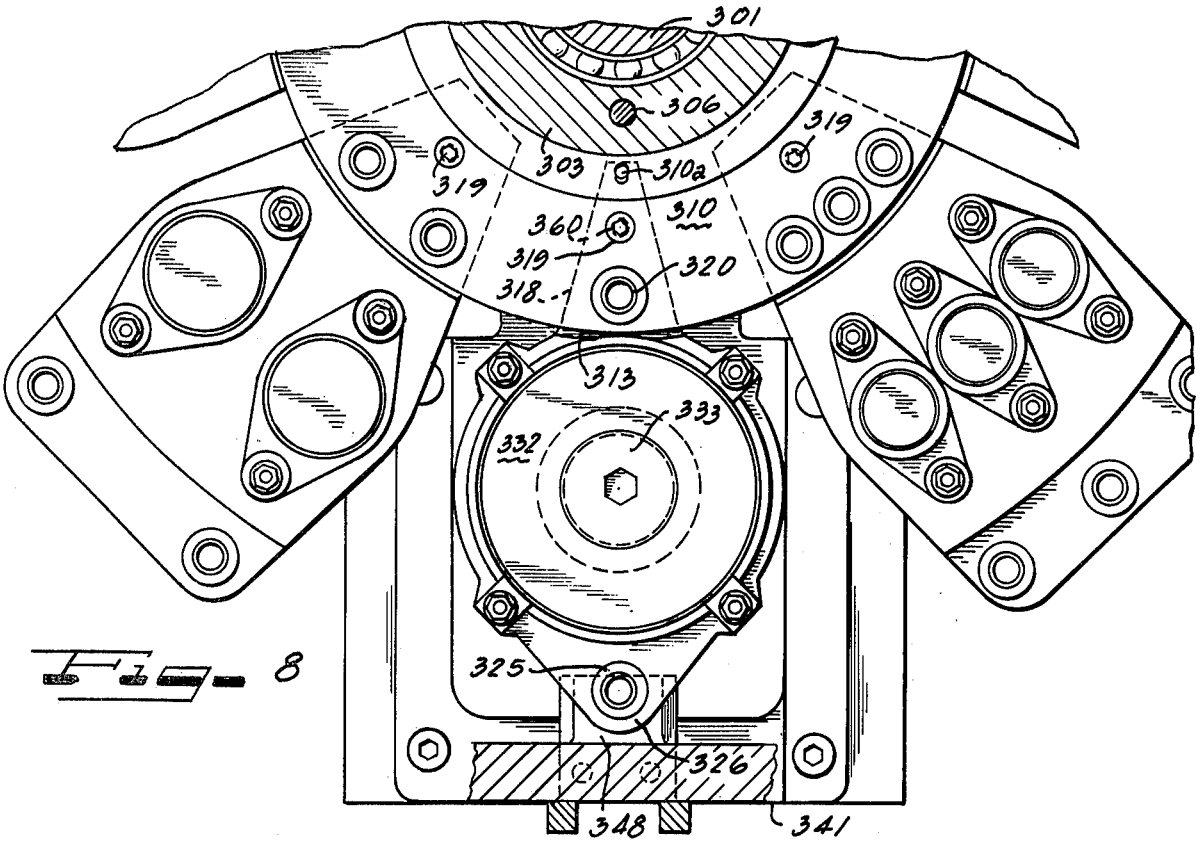
Fig. 8
Fig. 9
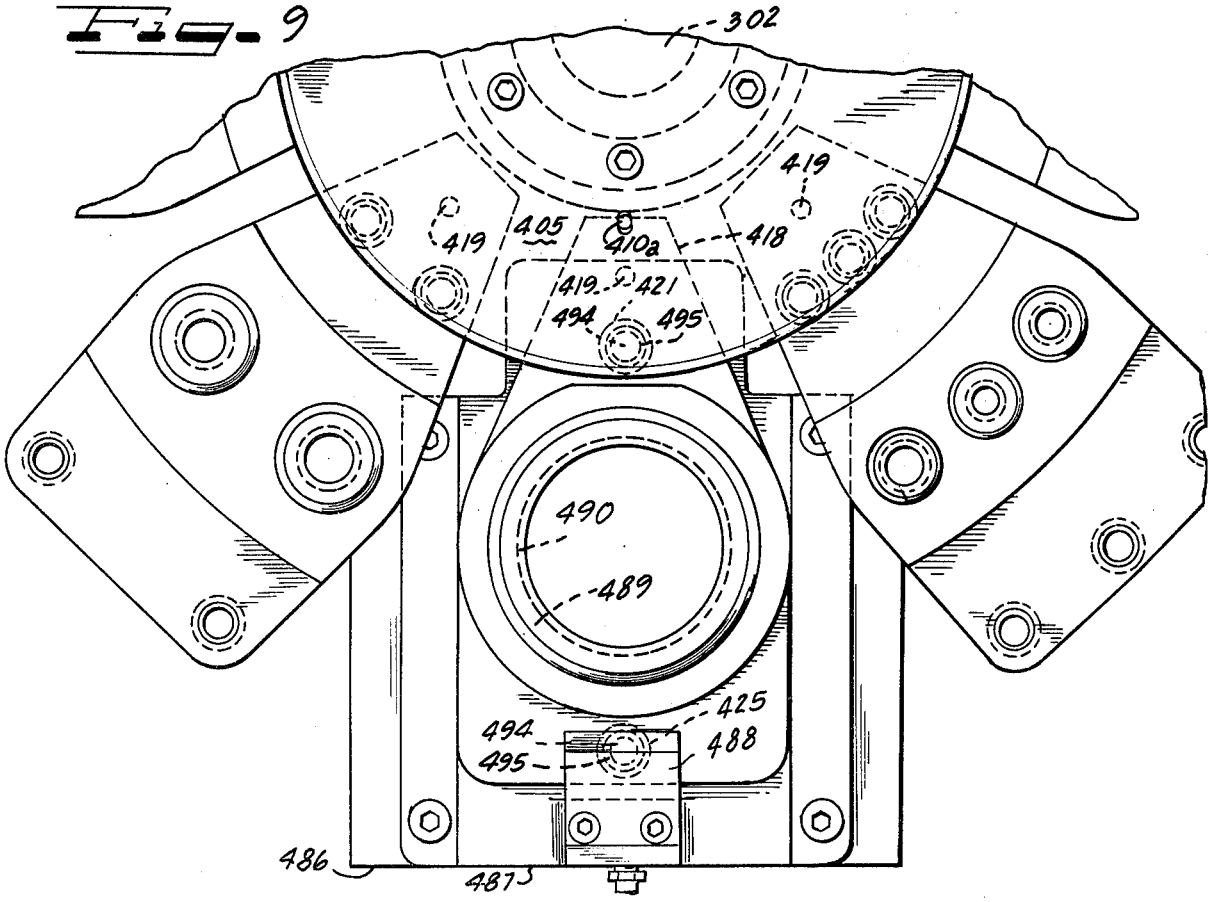

MODULAR TURRET PUNCH PRESS

This application is a continuation of application Ser. No. 698,473, filed June 21, 1976, now abandoned.

BACKGROUND OF THE INVENTION

1. Field of the Invention

This invention relates to machine tools and more particularly to turret punch presses.

2. Prior Art

Turret punch machines are normally equipped with upper and lower rotatable turret assemblies. Each assembly can generally be considered as consisting of a centrally mounted rotatable disc which has one or more ring-like areas adjacent its outer periphery in which tools are positioned. A normal turret punch press will have the upper turret disc, or table, carry a plurality of punches and the lower turret disc, or table, carry a plurality of dies.

It is common for both turret tables to be machined, the upper turret being machined with a plurality of openings extending axially therethrough in the ring area each of which opening individually receives one punch. The punch is generally one part of an assembly which may include the punch body itself, springs for returning the punch to a predetermined position, punch holder mechanisms, stripper mechanisms, stripper springs, etc. In its simplest form, the punch assembly is merely positioned in a hole in the turret. In more complex forms, the turret holes may be equipped with guide bushings for guiding the punch or its surrounding stripper and the turret may be further equipped with anchoring means, punch lifting devices, etc, each requiring specific machining of the table.

The die turret table is likewise a machined table and includes a plurality of axially extending openings in the ring area which serve as discharge openings for disposal of punched material. Means are then provided for mounting dies on the lower turret in the area of the machined openings. In a simplier form, the discharge openings may be counterbored adjacent one axial end and the dies may be seated in the counterbore. In more complex embodiments, the dies are carried in die holders which may be of two or more parts and which in turn are mounted on the turret table by means, such as bolts or the like, which require further machining of the lower turret table.

In addition, both turret tables will be equipped or provided with shot pin openings so that reciprocatably movable shot pins can be inserted into table shot pin openings to insure positive precise location of the tools carried by the table as well as a positive location of the tables with respect to one another.

Further, once it has been determined to create a two table turret punching machine, criticality of alignment of the machined openings in the upper turret table with machined openings in the lower turret table demands the application of extremely complex and cumbersome machining and assembly procedures. It is therefore clear that a large part of the expense of manufacturing turret punch presses is involved in the design, manufacture, and assembly of the turret tables which, when completed represent a substantial portion of the bulk of the machine.

Because the turret tables are difficult to manufacture and expensive, they are not generally considered to be a changeable part of the overall machine. Further because of their expense, they are produced in only a relatively small number of configurations. Thus the positioning of the various openings in a turret table is, for all practical purposes, set at the time of manufacture of the table. This has the effect of limiting the versatility of use of the overall punch press and requires that the purchaser pre-select from among the configurations of the turret tables offered and thereafter be limited to working with his choice. Since the versatility of the overall machine is then specified within a range which is a function of the turret table configuration chosen, the presently existing turret punch presses have inherent limitations restricting their overall versatility and applicability. Although it has been suggested to provide a device allowing placement of two small tools at turret positions which normally receive one large tool, see U.S. Pat. No. 3,951,026, nothing has been done to allow changing of turret configuration.

Another disadvantage of the prior art turret punch presses is in the area of tool changing. Tool changing is both restricted and time consuming. First, the variety of tools that can be provided on any turret is restricted by the configuration of that turret. It is not possible to put larger punches or dies in smaller openings. It is expensive, uneconomical and unaccurate to put smaller punches and dies in larger holes. Not only does this later situation require the use of bulky machined pieces to take up the clearance space, it introduces yet another set of interfaces having critical positioning requirements in order to assure that each punch is properly aligned with an associated die.

Further, tool changing requires a great deal of machine down time. In order to insure proper alignment of the punches with the upper turret, the upper turret opening may have a guide bushing formed as a part of the opening wall. If this is the case, then it is practically impossible to change punch body sizes or die holder sizes for any given opening and tool changing is limited to the replacement of punch tips and the replacement of the die. Even this simple change can become cumbersome in those instances where the associated punch assembly portions are carried by the turret. In other types of upper turrets where the majority of the punch assembly is self-contained in a punch housing which merely fits in a given opening, it is easier to change punch size to allow the use of a smaller punch in a larger turret opening. However changing punches in this type of a construction generally requires, at the least, removal of a number of bolts or the like.

Die changing is equally complex. Where the die holder is formed as a part of or is semi-permanently affixed to the lower table, it may be practically impossible to change die size for a given die opening. If not impossible, it requires the removal of portions of the die holder which are normally permanently affixed to the turret, thereby requiring complex realignment procedures when a new die holder is fastened to the turret. Even the relatively simple step of changing a broken or worn die with an equally sized die represents a complex problem requiring the removal of bolts and other die holder portions, all of which can result in substantial machine down time. Because of this, it is not considered to be a part of the standard operating cycle of presently existing turret punch presses to change over die sizes and varieties for relatively small production runs.

It would therefore be a definite advance in the art to provide a turret punch press wherein tool changing is facilitated and the down time necessary to accomplish tool change is reduced. It would further be a major advance in the art to provide a turret punch press overcoming the above described turret configuration limitations.

SUMMARY OF THE INVENTION

Our invention overcomes the disadvantages of the prior art and provides a turret punch press with substantially unlimited turret configuration and vastly simplified tool changing capabilities. In the preferred embodiments illustrated the upper and lower turrets consist of central rotatable hub sections with removable tool carrying sections positioned radially outwardly of the hub sections. The tool carrying sections are composed of a plurality of individual interchangeable modules which are carried by the turret hubs at module affixing positions on the turret hubs and which radially project from the hubs in spoke-like fashion. The module design is adaptable to differing tool sizes and tool numbers per module whereby a variety of different modules can be selected from. In this manner the configuration of the turret is determined by the number, size, style and individual position of modules selected to be affixed to central hubs.

The individual modules are attached to the hubs only at the radially inner ends of the modules. In one embodiment attachment is by means of a quick change spring snap fit connection while in another disclosed embodiment the attachment is by means of removable threaded fasteners. In both embodiments module changing is greatly simplified from the tool changing abilities of prior art turret punch presses.

Additionally, our invention teaches the provision of radially outer end supports for at least some of the modules at the work station and shot pin alignment means acting upon each of the tool receiving areas of each of the modules at the work station to assure proper alignment of tools and modules of both the upper and lower turrets.

Further, in one preferred embodiment we have shown a quick change module design allowing ease of tool change within the module itself.

It is therefore a general object of this invention to provide an improved turret punch press having a versatile tool selection and positioning configuration.

It is another general object of this invention to provide a turret punch press having quick tool change capabilities.

It is another object of this invention to provide a turret punch press wherein the turrets have tool carrying sections removable from central turret hub sections.

It is another and more specific object of this invention to provide a turret punch press wherein each turret carries a plurality of tools positioned in a plurality of individual modules which are removably attached to central turret hub sections whereby individual tools are changed by removing the tool associated module from the turret hub.

It is another specific object of this invention to provide a turret punch press having a plurality of tools carried by a plurality of modules detachably attached to central turret hub sections wherein the individual modules are adapted to carry different tool sizes and different numbers of tools whereby a large variety of tool sizes and numbers can be selected for attachment to the turret by selection of different interchangeable modules for attachment to the turret hub.

It is another and more specific object of this invention to provide a turret punch press wherein the turrets consist of a central rotatable hub sections carried by a machine frame with a plurality of individual interchangeable modules carried by each hub section, the modules extending radially outwardly of the hub section in a spoke-like fashion and having radially inner ends easily detachably affixed to the hubs, each of the modules carrying one or more tools of varying sizes and types, with means being provided at a work station to support the radially outer ends of the modules and with shot pin means being provided at the work station to accurately locate, position, and hold in place the modules and associated tools.

Other objects, features and advantages of the invention will be readily apparent from the following description of a preferred embodiment thereof, taken in conjunction with the accompanying drawings, although variations and modifications may be effected without departing from the spirit and scope of the novel concepts of the disclosure, and in which:

BRIEF DESCRIPTION OF THE DRAWINGS

FIG. 1 is a perspective view of a turret punch press according to this invention.

FIG. 3 is a fragmentary cross sectional view taken along the lines III—III of FIG. 2 showing the upper turret.

FIG. 5 is a fragmentary elevation view of a two piece module illustrating a latching mechanism.

FIG. 8 is a fragmentary cross sectional view taken along the lines VIII—VIII of FIG. 6 illustrating the upper turret.

FIG. 9 is a fragmentary cross sectional view taken along the lines IX—IX of FIG. 6 illustrating the lower turret.

DESCRIPTION OF THE PREFERRED EMBODIMENTS

Figure 2:
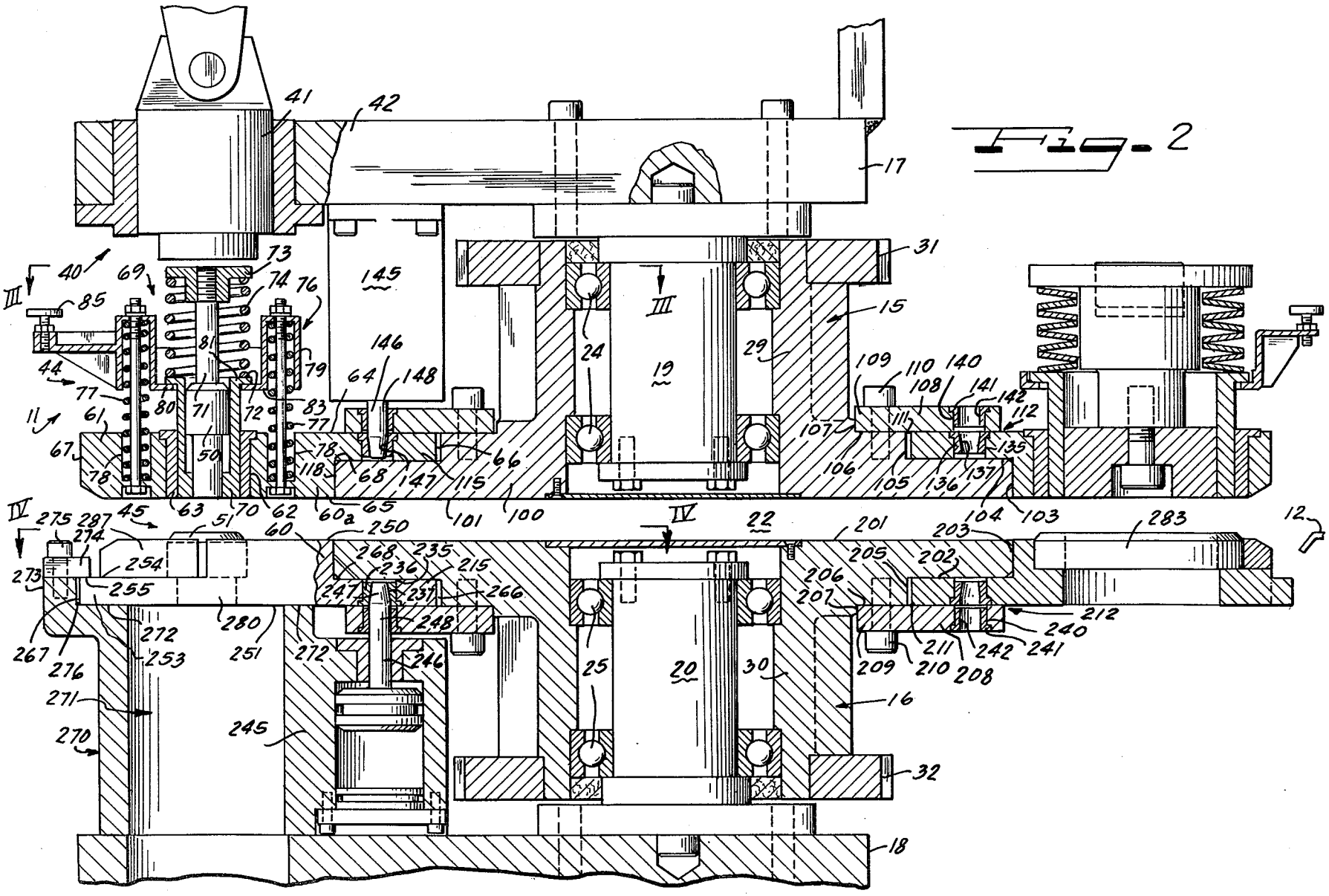
FIG. 2 is a cross sectional fragmentary view showing one embodiment of the upper and lower turrets of the punch press of this invention.

FIG. 1 illustrates a turret punch press 10 having a turret section 11, a work table 12, a work piece holding and feeding mechanism 13 and machine controls 14 which may be of the numerically controlled type.

FIG. 2 illustrates in greater detail a cross section of the turret area 11. The turret area 11 includes upper 15 and lower 16 turrets each rotatably carried by respectively upper 17 and lower 18 main frame portions through upper 19 and lower 20 main shafts. The turrets are axially spaced apart with a clearance 22 therebetween into which a work piece may project. Bearing assemblies 24 and 25 support rotatable turret hubs 29 and 30. The turret hubs include drive connections 31 and 32 which may be in the form of gear teeth, chain sprockets or the like and which are directly or indirectly coupled to motor means for rotation of the turret hubs about the shafts 19 and 20. At one point around the periphery of the turrets, a work station 40 is located. A ram 41 carried by connections 42 to the main frame acts upon tool 44 carried by one of the turrets to urge that tool 44 into cooperative position with tool 45 carried by the other turret.

As best illustrated in FIG. 2, normally the upper turret carries punch tools 50 while the lower turret carries die tools 51. In accordance with the teachings of this invention, these tools are carried in individual modules 60. The module 60*a* of the upper turret includes a base portion 61 having an aperture 62 therethrough, which aperture may be fitted with a guide bushing 63. The module has top 64 and bottom 65 main surfaces and has a radially inner end 66 and a radially outer end 67. The radially inner end is formed as an axially narrower tongue portion coplanar with the top face 64 but stepped from the bottom face 65 through a ledge 68.

The module 60*a* includes a punching assembly 69 which includes the punch tool 50 received in a stripping guide 70 with the tool having a shaft portion 71 projecting beyond the top end 72 of the stripping guide and terminating in a head 73 which may be threaded to the shaft portion. A stripping guide control spring 74 is interposed between the top 72 of the stripping guide and the head 73. A punch return assembly 76 includes compression spring members 77 fastened in bores 78 in the top face 64 of the module and projecting thereabove having ends received in a tool lifter 79. The tool lifter 79 has flange portions 80 underlying outturned flanges 81 of the top of the stripper guide. The clearance between an undersurface 83 of the lifter 79 and the top surface 64 of the module 60*a* is preferably maintained greater than the stroke of the ram 41 whereby, on the downstroke of the ram in contact with the head 73 of the punch, the springs 77 will be compressed due to downward movement of the flanges 81 of the stripper guide contacting the flange 80 of the tool lifter. Thereafter as the bottom of the stripper guide contacts the workpiece, movement of the stripper guide will cease and further descent movement of the ram will cause the punch to move through the workpiece into the die tool 51. At the bottom of movement of the ram, there will remain a clearance between the bottom face 83 of the tool lifter 79 and the top face 64 of the module. During upward movement of the ram, the spring 74 will insure that the punch is stripped from the workpiece and fully retracted inside the stripping guide 70. Thereafter, due to the springs 77, the punch will be raised to a fully lifted position. A height indicator 85 formed as a part of the tool lifter projects radially outwardly from the assembly and is used as a position sensor adjacent the work station in cooperation with a sensing element carried by the main frame to assure that the punch tool has been fully returned to its ready position prior to further operation of the punch press.

The central turret hub 29 of the upper turret 15 includes a radially extending support portion 100 at the bottom of the hub 29 which projects outwardly of the remainder of the hub and includes a bottom face 101 and a stepped top face 102. The support portion of this embodiment terminates in an outer diameter peripheral face 103 extending axially from the bottom face 101 to a first step or ledge 102. The first step or ledge 102 extends radially inwardly to a second axially extending outer peripheral face 105 which extends upwardly axially to a second step or ledge 106. The second step or ledge 106 extends radially inwardly to a third axially extending peripheral end face 107.

A ring member 108 has an inner diameter portion 109 overlying the second ledge 106 and fastened to the hub 29 by means such as bolts 110. The ring has a substantially flate bottom face 111 which extends outwardly beyond the outer peripheral face 105 of the support portion and overlies the ledge 102 in axially spaced relationship therewith providing a groove 112 between the ledge 102 and the bottom face 111 of the ring 108. The inner diameter axially reduced end portion 115 of the module 60*a* projects into the groove 112. The axial thickness of the inner end portion 115 is substantially equal to the axial spacing between the ledge 102 and the face 111 of the ring 108 whereby the module will be snugly received in the groove 112 with axial end face portion 118 of the module extending between the bottom face 65 and the module ledge 68 abutting the face 103 of the support portion 100 of the turret hub.

As best shown in FIG. 3, each of the upper turret modules 60*a* includes circumferentially space side walls 120 and 121 extending between the radially outer end wall 67 and the radially inner end wall 66 and contoured as at 123 to provide notches 124 projecting circumferentially into the modules. The notches preferably extend the full axial length of the module and cooperate with heads 125 of spring clips 126 carried by the hub 29. The spring clips 126 are received in the groove 112 and retained therein by fasteners 128 which may be in the nature of bolts or the like. The spring clips 126 are circumferentially spaced around the hub 29 and each clip includes two arms 130 and 131 separated by a groove 132 and commonly connected to a base 133. The arms each terminate in a head 125 having an arcuate peripheral wall projecting circumferentially away from the other arm of the clip. The heads 125 are dimensioned to snugly engage the notches 124 when the wall 118 of the module 60*a* is in full abutted relationship with the wall 103 of the hub 29. The spring clips may be constructed of any resilient material strong enough to maintain the modules in position, it being understood that a module equipped with a large diameter punch, for example 3½ inch diameter punch, may have a weight of upwards of 30 pounds. In addition the spring clips must be capable of maintaining the module in position under the influence of the ram and the resultant compression of the lifter spring 77.

In the embodiment shown, each of the modules 60*a* in the upper turret is formed with identical outer dimensions and the spring clips are equally circumferentially spaced apart. In this assembly any given module may be positioned in any given module receiving station, there being one module receiving station located between each pair of circumferentially spaced apart spring clips 126. As illustrated in FIG. 3, each module may carry one or a multiple number of tools. For purposes of clarity, we have shown three modules one of which is equipped with a single large diameter punch, a second of which is equipped with two intermediate diameter punches and a third of which is equipped with three smaller diameter punches. However, it is to be understood that these are matters of preference and the individual modules could be made larger and each could carry a larger number of tools. Further, it should be understood that it is not necessary for the practice of this invention that each of the modules be of identical outer size. The module receiving stations could be variously spaced around the periphery of the hub 29 and could be dimensioned to accept differing sizes of modules. However, the embodiment illustrated represents the most versatile and preferred construction, in that any module may be placed in any module receiving station.

As is illustrated in FIGS. 2 and 3, each module has a shot pin bore 135 for each tool carried by the module. The shot pin bores 135 extend axially through the radially inner end portions 115 and receive shot pin bushings 136 having tapered bores 137. The tool 69 carried by the module is precisely aligned on the module with respect to the shot pin bushing 136 and has a center point concentric to the surface 118. The center point of the tool or tools carried by any module is aligned on a radius extending from the hub center through the shot pin bushing and is radially positioned a set distance from the face 118, the face 118 in the preferred embodiment being arcuate and mating with the arcuate ledge face 103.

The ring 108 is also formed with shot pin openings 140 receiving shot pin bushings 141 having cylindrical bores 142. When the module 60*a* is received in the groove 112 with the face 118 abutting the face 103, and the spring clip heads 125 engaging the notches 124, the shot pin bushing 136 carried by the module will be aligned with a shot pin bushing 141 carried by the ring 108. In order to provide interchangeability of modules, the ring 108 is equipped with a number of shot pin bushings equal to the maximum number of tools carried by the modules. For example, if as in the embodiment illustrated, the maximum number of tools carried by a module is three, the ring 108 will be equipped with three shot pin bushings 141 for each module receiving station. Therefore, if a module carrying three tools is positioned at a module receiving station, three shot pin bushings in the ring 108 will be aligned with the three shot pin bushings in the module. If, however, a module having only one tool is positioned at that station, only one of the three shot pin bushings in the ring at that station will be aligned with a shot pin bushing in the module.

Adjacent the work station 40, a shot pin assembly 145 is carried by connection to the main frame and includes a reciprocatably movable shot pin 146 having a tapered end portion 147 and a cylindrical midportion 148. The shot pin 146 has an outer diameter dimension mating exactly with the bores 142 and 137 of respectively the shot pin bushings 141 and 136. Suitable controls are provided to engage the shot pin assembly 145 when a module is positioned at the work station to urge the shot pin through the bushing 141 and into the aligned module bushing 136 where the tapered head 147 of the shot pin will engage the tapered face 137 of the bushing 136 to accurately locate and position the module 60*a*. The tapered bushing not only assures that the module will be accurately located both radially and circumferentially but, due to the axial force applied by the shot pin, it will assure that the module is accurately positioned axially and is held in firm contact with the ledge 102. In this manner the shot pin assembly aids in offsetting the forces applied to the module 60 by the ram 41. The lower turret assembly 16 is similar to the above-described upper turret assembly 15. The lower turret includes a central turret hub 30 having a top face 201 which has a radially outer peripheral end face 203 extending downwardly to a first ledge 202 which extends radially inwardly to a second peripheral end face 205 which in turn, extends axially to a second ledge having a radial face 206 which terminates in an axial end face 207. A ring 208 has a radially inner portion 209 attached to the turret hub as by means of bolts 210 and a radially outer portion having a bottom face 211 overlying the ledge 202 in spaced relation therewith defining therebetween a groove 212. The module 60*b* has a top face 250 and a bottom face 251 with a radially inner tongue portion 215 extending beyond a ledge 268 to an axially inner end face 266. The tongue portion has a shot pin opening 235 receiving a shot pin bushing 236 with a tapered bore 237. The radially outer end 267 has a central projecting tongue portion 253 coplanar with the bottom face 251 and stepped from the top wall 250 by ledge 254 providing radially extending ledge face 255.

The ring 208 has shot pin bores 240 extending therethrough which receive shot pin bushings 241 which have cylindrical bores 242. A shot pin assembly 245 carried by main frame portion 18 is positioned at the work station and includes a shot pin 246 having a tapered end portion 247 and a cylindrical shaft portion 248. The shot pin 246 acts in concert with the shot pin bushings 241 and 236 in the same manner and to the same affect as the upper shot pin 145 acts in concert with the shot pin bushings 141 and 136.

As best illustrated in FIG. 2, a lower turret anvil assembly 270 is carried by the main frame portion 18 at the work station. The lower turret anvil includes a sleeve-like member 271 which underlies the module 60*b* at the work station and which includes top surfaces 272 which contact and support the bottom surface 251 of the module 60*b*. A radially outermost portion 273 of the anvil extends upwardly above the bottom 251 of the module and includes a retainer member 274 fastened to the top of the section 273 as by means of bolts 275. The retainer member extends radially inwardly and axially overlies portions of the surface 272 providing a groove 276 into which the radially outer tongue portion 253 of the module projects. In this manner, the lower turret module which carries die tools 51 is firmly positioned and retained at the work station due to the interrelationship between the shot pin and its cooperating bushings, including the tapered bore 237 and the tapered shot pin end 247, and the support surfaces 272 and the groove 276. In this manner the die modules are restrained against both axial and radial movement.

Figure 4:
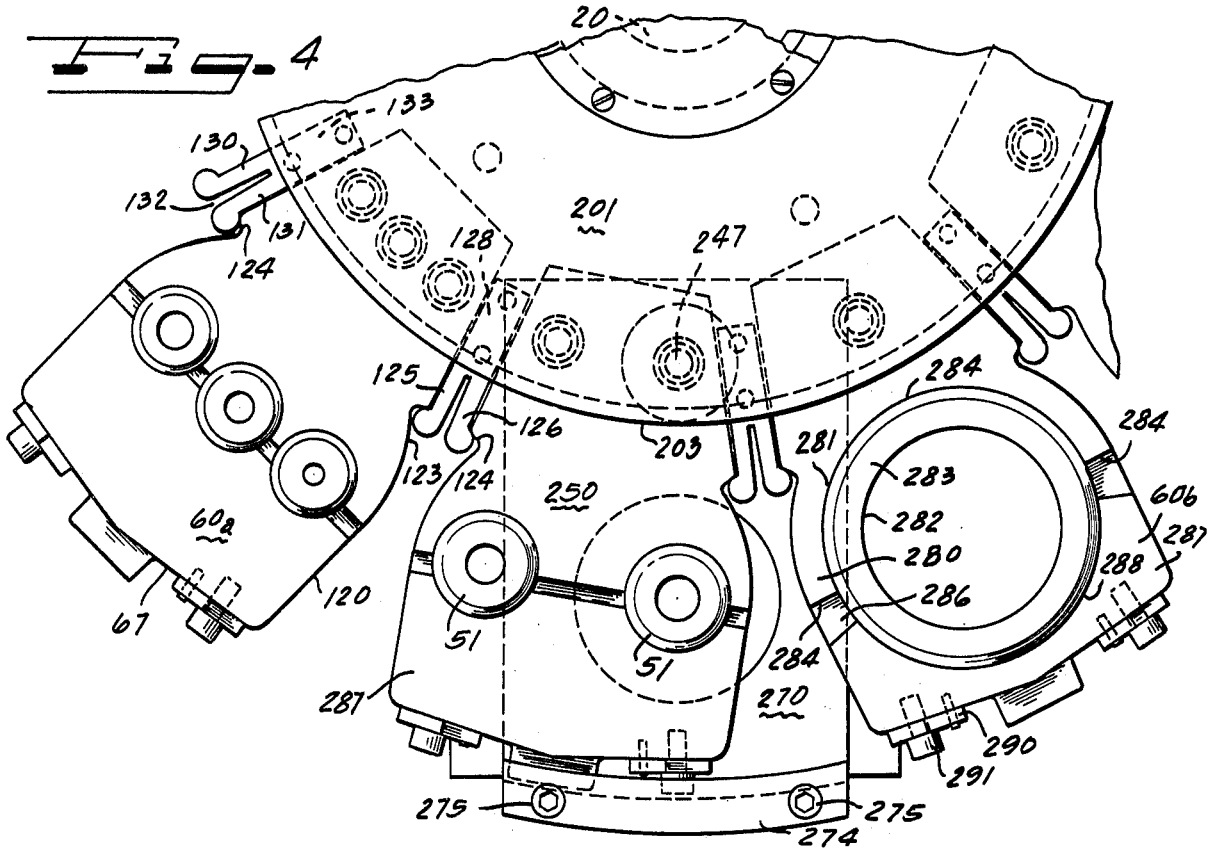
FIG. 4 is a fragmentary cross sectional view taken along the lines IV—IV of FIG. 2 showing the lower turret.
Figure 7:
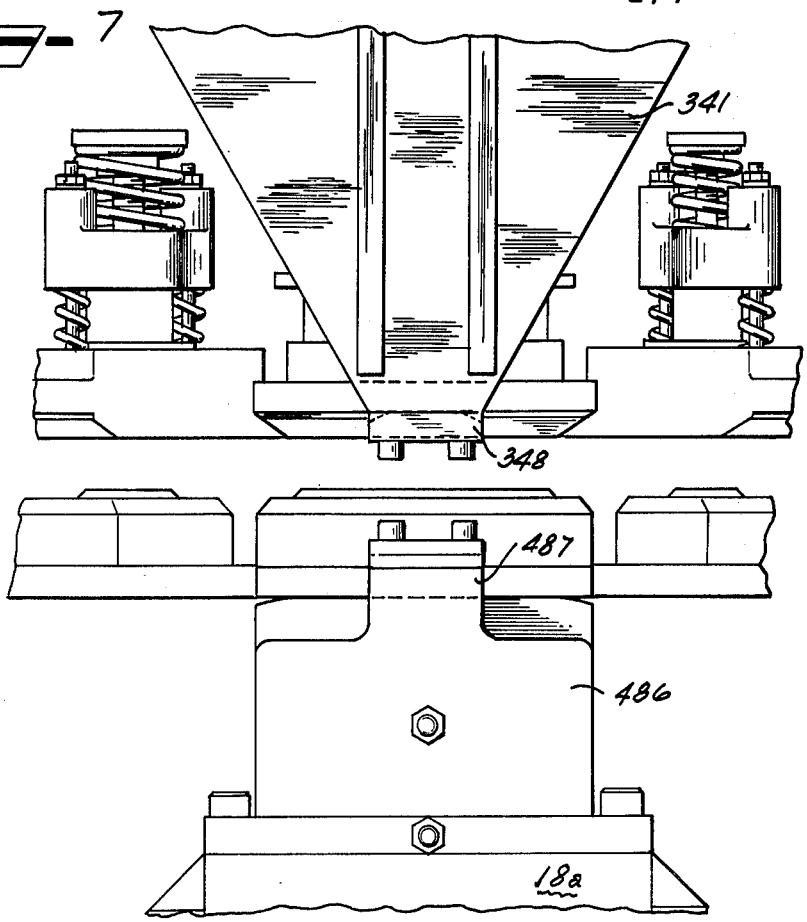
FIG. 7 is a front elevational fragmentary view of the embodiment of FIG. 6.

As best shown in FIG. 4, the outer dimensions and configuration of the lower turret modules 60*b* are similar to the dimensions and configurations of the upper turret modules 60*a* and the lower turret modules are retained in position on the lower turret hub by means of spring clips having heads interreacting with notches in a manner described above in association with the upper turret.

Additionally, the lower turret modules are formed with a base section 280 which is stepped having an axially reduced height at the radially outer portions. The module has a die receiving bore 281 therethrough which is stepped at 282 to provide a ledge 283 for support of the die. A radially inner wall portion 284 defining the bore opening 281 is formed by the base 280, however the wall 281 terminates as at 284 at approximately a diameter line normal to the radial line extending through the center of the shot pin opening and the center of the die opening. From there, radially outwardly, the base portion has a top surface 286 substantially coplanar with the ledge 283. A separate detachable part-collar portion 287 forms the remainder of the radially outer end portion of the module and is detachable from the base portion 280. The part-collar portion has a radially inside arcuate face 288 which is concentric and of equal diameter with the wall 284 when the part-collar portion is properly mounted on the base. In this manner the face 288 cooperates with the face 284 to snugly hold a die in place on the ledge 283. In order to hold the part-collar portion 287 in place on the base, swing tabs 290 best shown in FIG. 5 are carried by the radially outer face 267 of the base 280 and are fastened thereto as by means such as bolts 291. The tabs 290 are swingable to a position overlying the end face 293 of the part-collar portion 287 from a position as indicated by the dotted lines 293 not overlapping the part-collar. When in the position 293, the tabs allow easy removability of the part-collar portion which in turn allows easy removability of the individual die from the module in order to replace worn, chipped or broken dies.

It is to be appreciated that the lower turret modules **60*b*, in common with the upper turret modules 60*a***, may carry one or more tools. In the drawings we have chosen to illustrate modules carrying one, two and three dies. It should be noted that the multiple die modules are, as explained above in connection with the upper turret modules, equipped with multiple shot bushings located on radial lines intersecting the center of the die opening.

FIGS. 6 through 9 illustrate a second embodiment of our invention which, in common with the above described embodiment, involves the use of individual interchangeable tool carrying modules which are mounted for rotation on a turret hub and which are easily detachable therefrom. A primary area of difference between the first embodiment and the second embodiment lies in the manner in which the modules are attached to the turret hub and the mechanism by which they are aligned in proper position at the work station.

Figure 6:
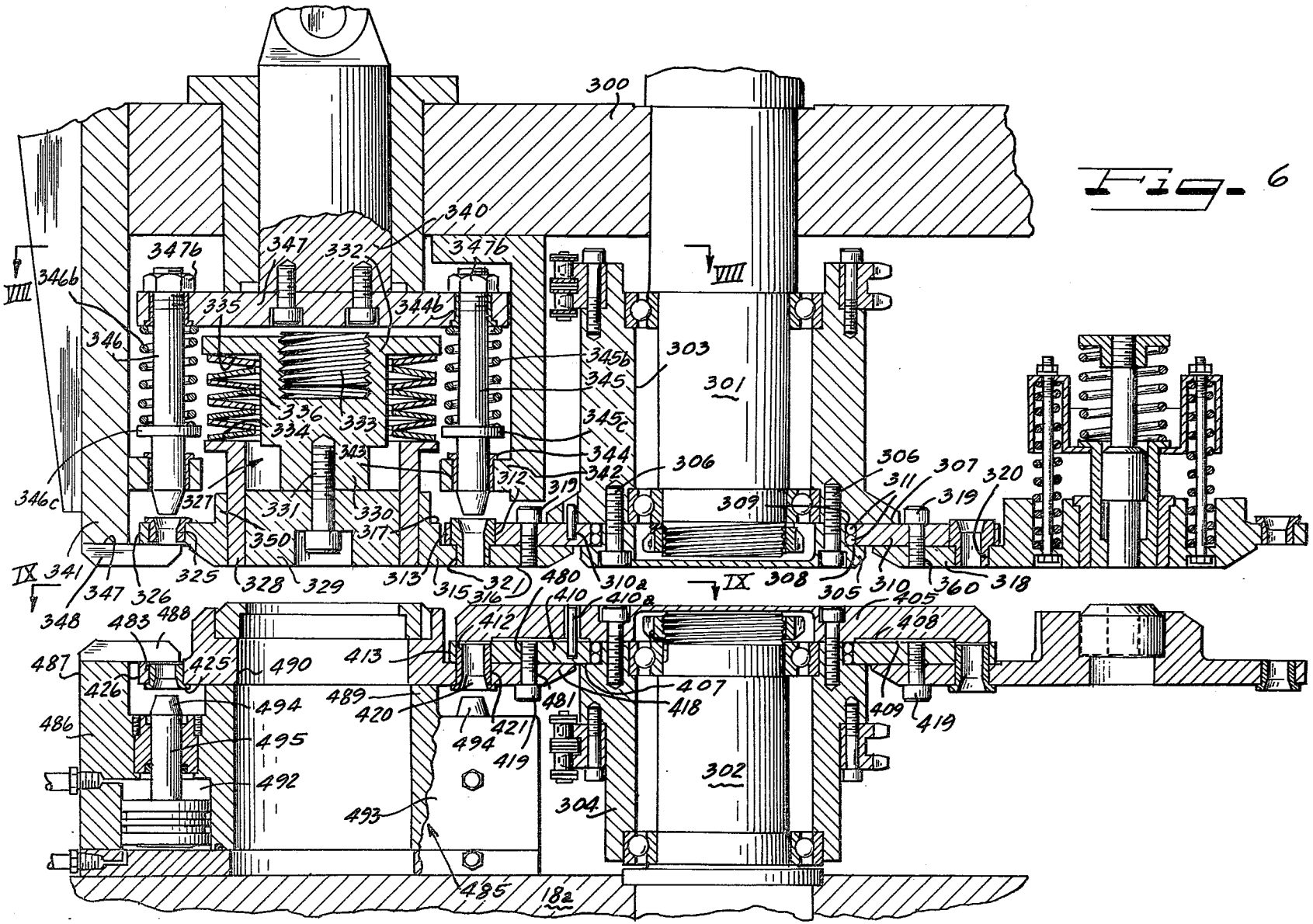
FIG. 6 is a fragmentary cross sectional view similar to FIG. 2 illustrating a second embodiment of this invention.

FIG. 6 shows the turret area of a punch press including the frame 300 mounted shafts 301 and 302 with upper 303 and lower 304 turret hubs mounted for rotation thereon. The upper turret hub includes a bottom hub cap 305 fastened as by means of bolts 306 to the main hub portion 303 and defining between a bottom face 307 of the main hub portion and a top face 308 of the hub cap 305 a groove 309. A ring member 310 is received in the groove and projects radially outwardly therefrom. Resilient hollow O-ring members 311 are positioned at the bottom of the groove 309 and contact the inner diameter face of the ring 310 to allow the ring to radially float. The ring 310 has a plurality of shot pin bushing openings 312 positioned circumferentially therearound adjacent an outer diameter 313 thereof. Modules 315 carried by the upper turret have a bottom face 316 and a stepped top face 317 with a radially inner tongue portion 318 attached to the ring 310 by means such as bolts 319. The modules include shot pin bushings 320 carried in shot pin openings 321, the bushings being extensible through the shot pin bushing openings 312 of the ring 310 when the module is attached to the ring. The shot pin bushings 320 partially overlie the tongue 318. Additional shot pin bushings 325 are carried by the modules adjacent the radially outer end 326 of the modules 315. Punch tool assemblies 327 are also carried by the modules. In the embodiment illustrated a large diameter punch has been shown which includes a punch tip 329 fastened to a punch body 330 by means such as a bolt 331. A punch cap 332 may include a centrally disposed nut 333 which is adjustable to maintain height of the overall punch assembly 327. A stripping guide 328 surrounds the punch tip and portions of the punch body and has a flange 334 at a top end thereof which underlies in spaced relationship a shoulder 335 of the punch head. Spring washers 336 extend between the flange 334 and the shoulder 335 and function in the same manner as the spring 74 of the smaller diameter punch assembly illustrated in FIG. 2. Additional springs (not shown in this view) equivalent to the spring 77 function as tool lifters.

At the work station positioned under the ram 340, frame carried supports 341 project downwardly from the frame and include inturned bosses 342 having shot pin bushing openings 343 and shot pin bushings 344 received therein in generally vertical alignment with the bushings 320 and 325 of a properly positioned module. Radially inner 345 and outer 346 shot pins are carried by a cross bar 347 mounted on the ram 340 for movement therewith. Bushings **344*b* in the cross bar 347 receive the upper ends of the shot pins 345 and 346. Nuts 347*b* retain the shot pins and springs 345*b* and 346*b* on the undersurface of the cross bar and on flanges 345*c* and 346*c*** of the shot pins.

The shot pins extend through and are guided by the bushings 344. The radially outer frame mounted support 341 has a bottom end 347 terminating in a radially inturned boss 348 which underlies the end 326 of the module 315 and provides support for the radially outer end section of the module at the work station. Upon descent of the ram 340, the shot pins 346 will project into the tapered bushings 320, 325 under pressure of the springs **345*b* and 346*b* to firmly align the module 315. Since the tool opening 350 in the module is manufactured in alignment with the bushings 320, 325, the shot pins will assure precise alignment of the tool at the work station. The non-fastened anchoring of the ring 310 in the groove 309 allows the descending shot pins to slightly move the module to assure precise positioning while, however, the entrapment of the ring 310 in the groove 309 will be sufficient to hold the module in generally correct positioning relative to the turret hub at areas other than the work station. Drive pins 310*a* connect the hub 303 to the ring 310**.

As shown in FIG. 8, the modules 315 are similar to the upper turret module **60*a* shown in FIG. 3 with the addition of threaded openings 360 for receipt of the bolts 319 and with the delection of the notches 124. In this embodiment the spring clips 126 are not utilized inasmuch as the modules are firmly carried by the ring 310. However, as can be seen from a view of the right hand side of the upper turret of FIG. 6, module removal is relatively simple, requiring only a withdrawal of the bolt 319** at a position other than the work station.

As shown in FIG. 6, the lower turret hub 304 has a turret cap 405 positioned thereon which extends radially outwardly having an undersurface 408 radially overlying, in part, a ledge surface 407 of the turret hub 304 forming a groove 409 therebetween in which a ring 410 is received, the ring having a plurality of circumferentially spaced apart shot pin bushing openings 412 adjacent its radially outer end portion 413. The module 415 is attached to the ring 410 as by means of a bolt 419 extending into a threaded opening 480 in the ring 410. Drive pins **410*a* connect the ring 410 to the hub cap 405. The module has a radially inwardly extending axially reduced tongue portion 418 having a bore 481 therein for receipt of the bolt 419. An axially reduced radially outer end tongue 426 of the module has a portion 483 receiving a shot pin bushing 425 while the radially inner tongue portion has a shot pin bushing bore 421 receiving a shot pin bushing 420. A die anvil assembly 485 is carried by the main frame 18*a* at the work station and includes a radially outer vertically extending frame carried portion 486 having a top nose portion 487 which has an inturned support 488 which overlies the radially outer end portion 483 of the module 415. A radially inwardly spaced vertically extending portion 489 of the portion 486 is formed as a cylindrical portion underlying and contacting the module outboard of the slug chute 490 of the die carrying module 415 with the module 415 resting on the end wall of the portion 489. Shot pin assemblies 492 and 493 are also carried by the frame 18***a* at the work station and include taper headed 494 shot pins 495 which are actuatable to be brought into contact with the bushings 420 and 425 to properly precisely align the modules 415 at the work station.

As illustrated in FIG. 9, the module 415 of the lower turret of this embodiment may be formed as a single piece receiving the dies snugly in ledged die openings in place of the two piece modules illustrated in FIG. 4. Once again the modules 415 are similar to the modules 315 and are equipped with bores 481 which, however unlike the modules 315 are not threaded.

It can therefore be seen from the above that our invention provides a novel turret punch press wherein the punch and die tools are carried by individual modules hung from central turret hubs and extending radially outwardly therefrom in spoke-like fashion. The individual modules are preferably interchangeable with one another in their attachment to the hubs at various module attaching locations. Each module may carry one or a plurality of tools. We have shown differing methods of attaching the modules to the hubs and we have further illustrated and described methods and apparatus for positively precisely positioning the modules at the work station and for supporting the modules at the work station. In addition illustrative designs for modules and accompanying tooling and tooling mounting have been described.

Although the teachings of our invention have herein been discussed with reference to specific theories and embodiments, it is to be understood that these are by way of illustration only and that others may wish to utilize our invention in different designs or applications.

We claim as our invention:

1. In a turret punch press having a plurality of die tools rotatably carried by a turret and retained in die tool holders on said turret, the improvement of said die tool holders formed as individual modules individually detachable from the remainder of the turret, said modules including a base portion and a part-collar portion, the part-collar portion having an engagement face dimensioned to snugly engage a peripheral portion of a die tool carried by the module in an opposition to an engagement face of the base portion dimensioned to snugly engage an opposite peripheral portion of the die tool, the part-collar portion removably attached to the base portion.

2. In a turret punch press having upper and lower rotatable turrets, the improvement of at least one of said turrets composed of a plurality of individual tool carrying modules, each of said modules having a radially inner end and a radially outer end, each of said modules detachably attached to the turret adjacent the radially inner end with portions of a hub portion of the turret in overlapping relationship with the radially inner end, a main frame for said turret press, a work station for said turret press, support means positioned at least at said work station carried by said main frame, said support means overlapping a portion of the radially outer end of a module located at said work station.

3. A turret punch press comprising, a frame, upper and lower rotatable turrets carried by said frame, at least one of said turrets composed in part of a plurality of individual modules detachably connected to a turret hub section adjacent a radially inner portion of the module, said attachment including circumferentially spaced side walls on said module and spring clips carried by said turret central portion engageable with said side walls and effective to aid in maintaining said module in coupled relationship with said turret.

4. The press of claim 3 wherein a radially inner end portion of the modules projects into a groove in the turret central portion limiting axial movement of the radially inner end portion of the module, the spring clips limiting radial movement of the module.

5. The punch press of claim 4 wherein the press includes a work station, the modules have a radially outer end, and a support platform carried by said frame is positioned at least at said work station, said support platform underlying a module positioned at said work station carried by at least one of said turrets.

6. In a turret punch press having upper and lower turrets, the improvement of at least one of the turrets composed in part of a hub portion and a plurality of individual modules each carrying at least one tool and each detachable from the remainder of the turret, a work station for said press and a shot mechanism adjacent said work station engaged with a module positioned at the work station aligning and locating said module precisely at work station, said modules detachably attached at the central hub portion of the turret with the modules freely extending outwardly therefrom in a spoke-like fashion.

7. The punch press of claim 6 wherein the hub portion has portions thereof underlying portions of the modules.

8. The punch press of claim 7 wherein the hub portion has second portions thereof overlying portions of the modules whereby module portions are received between hub portions.

9. In a turret punch press having upper and lower rotatable turrets, the improvement of at least one of the turrets composed in part of a plurality of individual interchangeable modules each carrying at least one tool and each individually detachable from the remainder of the turret, said modules having radially inner portions positioned radially inwardly of a center of the module carried tools, the press having a work station and actuatable means at the work station engageable with a module at the station and effective by engagement with the module to position the module at the work station independently of the one turret.

10. In a turret punch press having upper and lower turrets, the improvement of each of said turrets composed in part of a plurality of individual interchangeable modules each carrying at least one tool and each individually detachable from the remainder of the associated turret, a work station for said press and shot mechanism attached to said press adjacent said work station, at least one of said shot mechanisms engageable with a module carried by said lower turret positioned at said work station to align said lower turret module and another of said shot mechanisms engageable with an upper turret carried module positioned at said work station to align said upper turret module, said shots effective to maintain alignment between the shot engaged upper and lower turret modules at the work station with respect to one another whereby the tools carried by said modules are aligned at said work station said shot mechanisms effective, by engagement with said modules to align said modules at the work station independently of the turrets.

11. In a turret punch press having a plurality of punch assemblies rotatably carried by a turret means with each punch assembly including punch return springs resiliently urging said punches to a ready position out of engagement with an associated die carried by a second turret means, the improvement of a least some of said punches and some of said dies carried by individual modules detachable from the remainder of said turret, the return springs for the some of said punches carried by the punch carrying modules and effective to move said punches with respect to said modules, each module having at least one tool carrying opening, each module provided with a shot receiving localized configuration precisely positioned with respect to each tool carrying opening of the module for positioning the module and tool at a press work station for receipt of a work station located shot, the punches and dies received in the openings of the module.

12. In a turret punch press having upper and lower rotatable turrets, a plurality of individual tool assemblies carried by each turret, a work station at which tools carried in the upper and lower turrets coact to work upon a work piece positioned therebetween and shot pin means carried by a stationary portion of the press effective to provide tool alignment at the work station, the improvement of each of said turrets formed of a plurality of parts including a central hub section rotatably carried by a main press frame and a plurality of independent modules attached to the central section and individually removable therefrom, the modules equipped with tool assemblies, the modules extending radially outwardly from the central section, and the shot pin means acting on one module at the work station and effective to align the one module independently of the turret associated with the one module.

13. The improvement of claim 12 wherein the central portions of the upper and lower turrets have module support portions projecting radially therefrom overlapping portions of the modules, remaining portions of the modules projecting radially beyond the module support portions whereby the outer periphery of each turret is defined by modules.

14. A punch press comprising: a main frame rotatably carrying upper and lower axially spaced apart coaxial turrets, a punch press work station at one point of the punch press adjacent the circumference of the turrets, each of said turrets having a plurality of circumferentially spaced module receiving stations, each of said stations including means for circumferentially adjustably securing a module in position at said station, a plurality of modules for each of said turrets, each of said modules interchangeably attachable to one of said turrets at a plurality of the module receiving stations of the turret, some of said modules having punch tools affixed thereto and being attachable to a punch carrying turret and some of said modules having die tools affixed thereto and being attachable to a die carrying turret, shot means adjacent the work station actuatable to engage each of the modules at the work station for positively aligning an upper turret module tool at the work station with a lower turret module tool at the work station.

15. A punch press comprising: a main frame rotatably carrying upper and lower axially spaced apart coaxial turrets, a punch press work station at one point of the punch press adjacent the circumference of the turrets, each of said turrets having a plurality of circumferentially spaced module receiving stations, each of said stations including means for securing a module in position at said station, a plurality of modules for each of said turrets, each of said modules interchangeably attachable to one of said turrets at a plurality of the module receiving stations of the turret, some of said modules having punch tools affixed thereto and being attachable to a punch carrying turret and some of said modules having die tools affixed thereto and means adjacent the work station acting upon the modules at the work station for positively aligning the upper turret module tool at the work station with the lower turret module tool at the work station, the means for securing said modules includes spring clips resiliently engageable with portions of said modules to hold the modules in position at the module receiving stations.

16. The punch press of claim 15 wherein the means for securing said modules includes bolt connections between turret portions and module portions, the bolts being removable to allow exchange of modules.

17. A punch press comprising: a main frame, upper and lower rotatable axially spaced apart coaxial turret members carried by said main frame, and means for varying the tool carrying configuration of said turret members comprising a plurality of individual tool carrying modules mounted on each of said turret members for rotation therewith, said modules easily detachable from the remainder of said turret members, and said modules replaceable on said turret member by other modules carrying different tools, the modules attachable to said turret members in secure, slightly relatively movable relation, and means at a work station of said punch press acting on a module located at the work station for precisely positioning the module located at the work station.

18. A punch press comprising: upper and lower spaced apart rotatable turrets, a plurality of individual tool carrying modules attached to and carried by said turrets and means allowing radial movement of at least one of said modules with respect to portions of said turret while maintaining said attachment and second means at a work station of the press for positioning the modules independently of the turrets with respect to the work station and to one another.

* * * * *

UNITED STATES PATENT AND TRADEMARK OFFICE

CERTIFICATE OF CORRECTION

PATENT NO. : 4,165,669

DATED : August 28, 1979

INVENTOR(S) : Paul R. Brown et al.

It is certified that error appears in the above—identified patent and that said Letters Patent is hereby corrected as shown below:

Column 2, line 46, "size" should read -- sizes -- .

Column 6, line 4, "flate" should read -- flat -- .

Column 13, line 16, "modules" should read -- module --.

Signed and Sealed this

Tenth Day of June 1980

[SEAL]

Attest:

SIDNEY A. DIAMOND

Attesting Officer

Commissioner of Patents and Trademarks